US007101107B1

(12) United States Patent
Byun

(10) Patent No.: US 7,101,107 B1
(45) Date of Patent: Sep. 5, 2006

(54) COSMETICS BRUSH

(76) Inventor: Young Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 0 days.

(21) Appl. No.: 11/269,803

(22) Filed: Nov. 9, 2005

(30) Foreign Application Priority Data

Apr. 29, 2005 (KR) ..... 10-2005-0035921
Oct. 11, 2005 (KR) ..... 10-2005-0095352

(51) Int. Cl.
*A46B 11/04* (2006.01)

(52) U.S. Cl. ..... 401/286; 401/188 R; 401/187; 401/176; 401/178; 401/269; 132/313

(58) Field of Classification Search ..... 401/286, 401/282, 283, 188 R, 187, 176, 177, 178, 401/146, 150; 132/313, 317, 318, 320
See application file for complete search history.

(56) References Cited

U.S. PATENT DOCUMENTS 1,044,996 A * 11/1912 Cuthbertson ..... 401/188 R
3,910,706 A * 10/1975 Del Bon ..... 401/286
4,236,651 A * 12/1980 Meyer et al. ..... 401/178
4,940,351 A * 7/1990 Konose ..... 401/286
4,993,437 A * 2/1991 Kimura et al. ..... 401/287
6,056,470 A * 5/2000 Nehashi et al. ..... 401/176
6,142,695 A * 11/2000 Byun ..... 401/188 R
6,209,548 B1 * 4/2001 Harrison et al. ..... 401/206
6,234,181 B1 * 5/2001 Lou ..... 132/313
6,363,948 B1 * 4/2002 Choi ..... 132/313
6,418,939 B1 * 7/2002 Byun ..... 132/313
6,508,256 B1 * 1/2003 Byun ..... 132/313
6,533,482 B1 * 3/2003 Byun ..... 401/188 R
6,935,802 B1 * 8/2005 Byun ..... 401/188 R
6,948,875 B1 * 9/2005 Jang ..... 401/188 R
2003/0000544 A1 * 1/2003 Byun ..... 132/320
2005/0053415 A1 * 3/2005 Byun ..... 401/188 R

* cited by examiner

*Primary Examiner*—Khoa D. Huynh
(74) *Attorney, Agent, or Firm*—Birch, Stewart, Kolasch & Birch, LLP

(57) ABSTRACT

A cosmetics brush, and more particularly, to a cosmetics brush in which cosmetics liquid is discharged to a brush using the air pressure generated by pressing an inner body is provided. In the cosmetics brush, the lower part of the inner body whose upper part is thread coupled by a coupler and that includes a sealing ring in the inside thereof is pressed so that the cosmetics liquid stored in the inner body is discharged to the brush through liquid guiding passages and a discharge hole formed in a discharger and a liquid transporting tube due to the air pressure generated while the inner body ascends and descends to let a user apply make-up. Since the inner body thread coupled with the coupler can be separated and refilled with cosmetics liquid when cosmetics liquid is exhausted, the cosmetics brush is economical and convenient.

1 Claim, 4 Drawing Sheets

COSMETICS BRUSH

CROSS-REFERENCE TO RELATED APPLICATIONS

This application claims the benefit of Korean Patent Applications No. 10-2005-0035921 and 10-2005-0095352, filed on Apr. 29, 2005 and Oct. 11, 2005, respectively in the Korean Intellectual Property Office, the disclosures of which are incorporated herein by reference.

BACKGROUND

1. Field of the Invention

The present invention relates to a cosmetics brush, and more particularly, to a cosmetics brush to which cosmetics liquid is discharged using air pressure generated by pressing an inner body. The lower part of the inner body whose upper part is thread coupled by a coupler and that includes a sealing ring in the inside thereof is pressed so that the cosmetics liquid stored in the inner body is discharged to the brush through liquid guiding passages and a discharge hole formed in a discharger and a liquid transporting tube due to the air pressure generated while the inner body ascends and descends to let a user apply make-up. The inner body thread coupled by the coupler can be separated when cosmetics liquid is exhausted so that the inner body is refilled. Therefore, it is possible to easily refill the inner body with cosmetics liquid and to easily assemble the inner body.

The number of parts that constitute the cosmetics brush is small so that it is possible to easily assemble the cosmetics brush. The inner body is assembled in package units of two parts to be supplied to a company before filling the inner body with cosmetics liquid so that it is possible to easily fill the inner body with cosmetics liquid and to easily assemble a container.

2. Discussion of Related Art

A cosmetics liquid filled cosmetics brush in which cosmetics liquid and cosmetics goods used for applying the cosmetics liquid are integrated with each other is know.

However, since the conventional cosmetics brush is composed of independent parts that are connected to each other, the number of parts that constitute the cosmetics brush is large so that manufacturing expenses increase. In particular, when the independent parts are connected to each other, it is difficult to keep the parts tightly sealed up so that it is difficult to reduce a defective proportion to no more than a predetermined level.

Also, since the number of parts that constitute the cosmetics brush is so large that assembling and manufacturing processes are complicated and that the parts assembled in minimum package units are assembled in package units of no less than four parts to be supplied to a company before filling cosmetics liquid, the number of parts to be assembled after filling the cosmetics liquid is large so that assembling processes are complicated.

SUMMARY OF THE INVENTION

In order to solve the above-described problems, it is an object of the present invention to provide a cosmetics brush capable of refilling cosmetics liquid in which the lower part of an inner body whose upper part is thread coupled by a coupler and that includes a sealing ring in the inside thereof is pressed so that the cosmetics liquid stored in the inner body is discharged to the brush through liquid guiding passages and a discharge hole formed in a discharger and a liquid transporting tube due to the air pressure generated while the inner body ascends and descends to let a user apply make-up and in which the inner body thread coupled by the coupler can be separated when cosmetics liquid is exhausted so that the inner body is refilled.

Also, it is another object of the present invention to provide a cosmetics brush capable of easily filling cosmetics liquid and of easily assembling a container by reducing the package units of the cosmetics brush to be supplied to a company.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Hereinafter, preferred embodiments of the present invention will be described with reference to the accompanying drawings.

Figure 1:
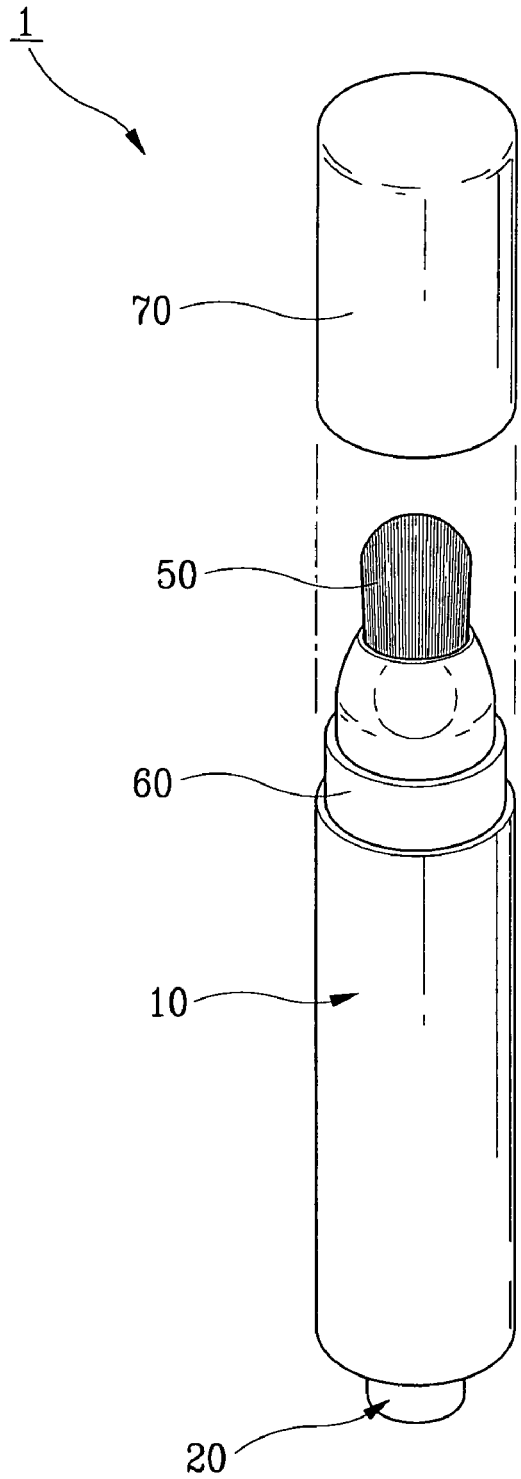
FIG. 1 is a perspective view of a cosmetics brush according to the present invention.
Figure 2:
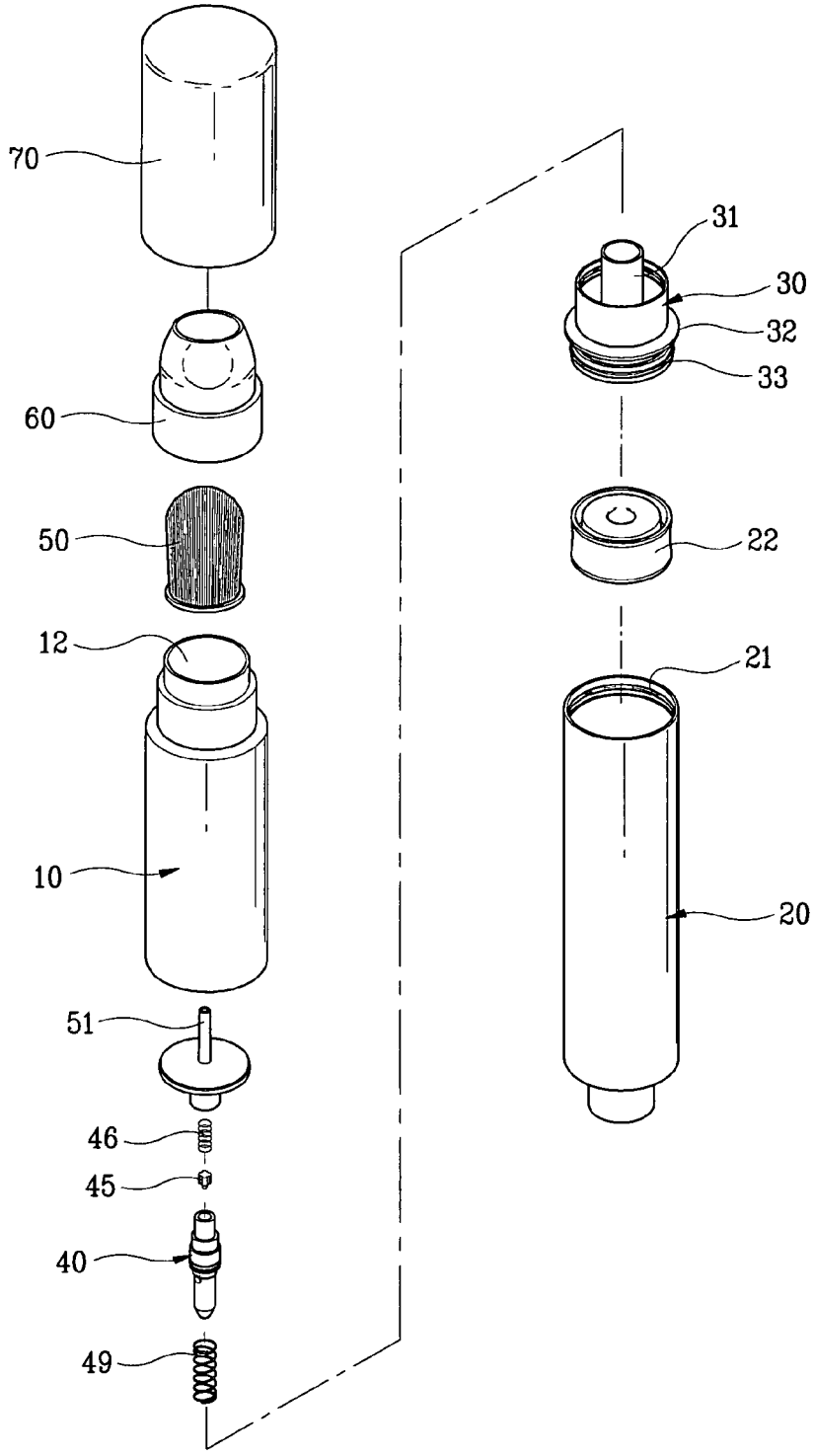
FIG. 2 is an exploded perspective view of the cosmetics brush according to the present invention.
Figure 3:
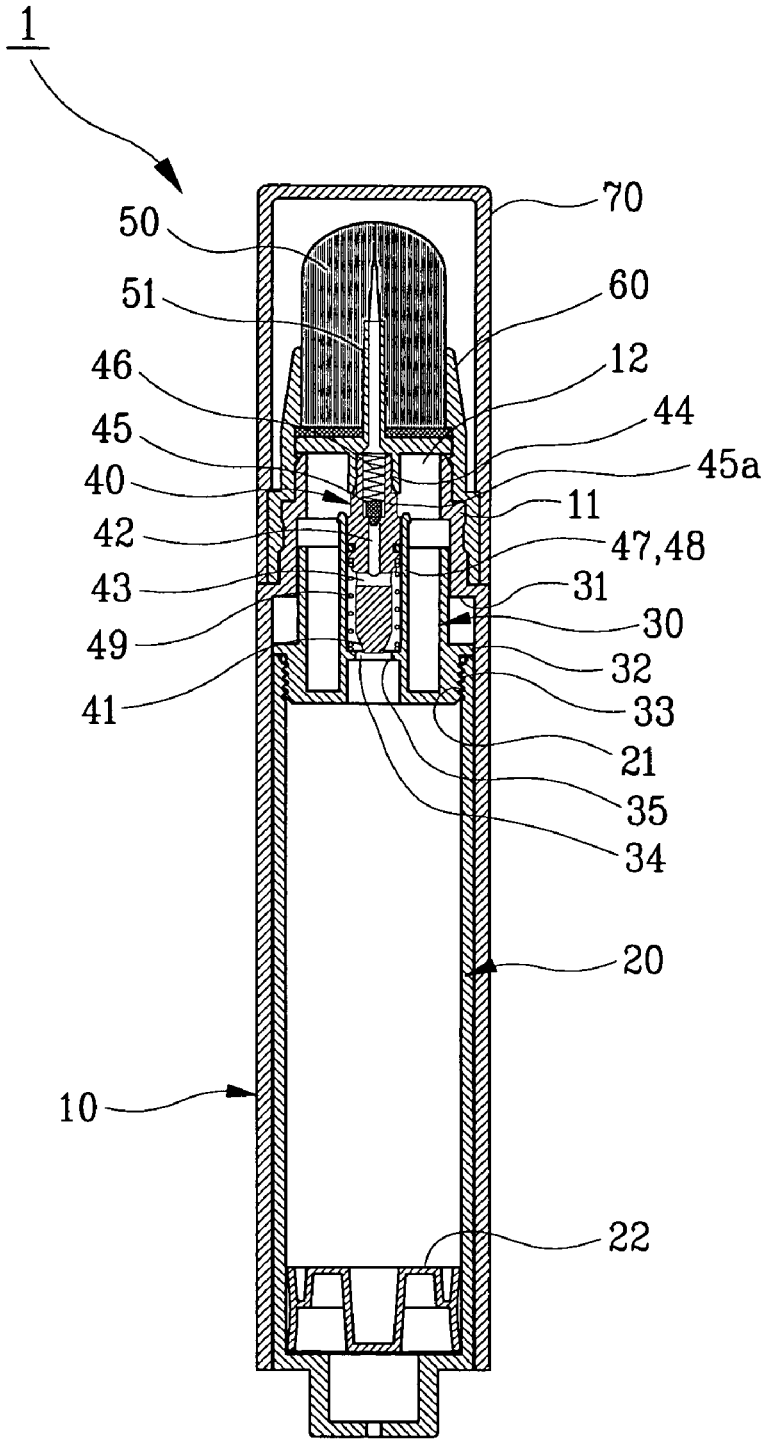
FIG. 3 is a sectional view of the cosmetics brush illustrated in FIG. 2.
Figure 4:
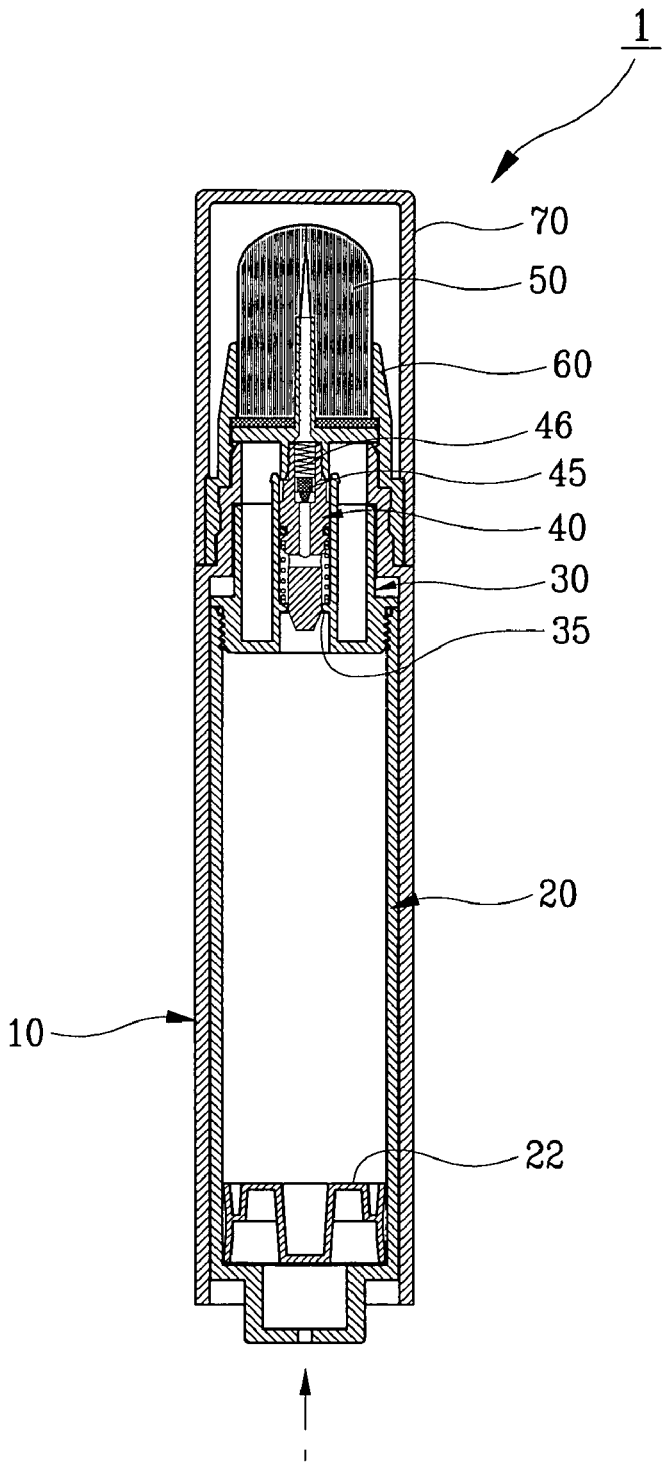
FIG. 4 is a sectional view illustrating a state in which a discharger ascends.

FIG. 1 is a perspective view of a cosmetics brush according to the present invention. FIG. 2 is an exploded perspective view of the cosmetics brush according to the present invention. FIG. 3 is a sectional view of the cosmetics brush illustrated in FIG. 2. FIG. 4 is a sectional view illustrating a state in which a discharger ascends.

The outer body 10 of a cosmetics brush 1 according to the present invention is thread coupled with the upper part of the cosmetics brush 1 by a coupler 30. The lower part of an inner body 20 including a sealing ring 21 in the inside thereof is pressed so that the cosmetics liquid stored in the inner body 20 is properly discharged to a brush 50 through vertical and horizontal liquid guiding passages 42 and 43, a discharge hole 44, and a liquid transporting tube 51 formed in a discharger 40 by the air pressure generated while the inner body 20 ascends and descends, that the inner body 20 descends due to the elastic force of a spring 49 provided in the coupler 30 formed in the upper part of the inner body 20 and returns, and that the vertical liquid guiding passage 42 is closed by a spring 46 and a check valve 45 provided in the discharge hole 44 to prevent cosmetics liquid from being discharged. The inner body 20 ascends and descends by pressing and releasing the lower part of the inner body 20 so that it is possible to freely discharge the cosmetics liquid stored in the inner body 20 to the brush 50 through the vertical and horizontal liquid guiding passages 42 and 43, the discharge hole 44, and the liquid transporting tube 51 formed in the discharger 40 and to freely prevent the cosmetics liquid from being discharged to the brush 50.

Also, the inner body 20 thread coupled by the coupler 30 can be separated and refilled with cosmetics liquid when cosmetics liquid is exhausted.

Hereinafter, the present invention will be described in detail with reference to the attached drawings.

As illustrated in FIGS. 2 to 4, according to the present invention, in the outer body 10, an upper insertion part 11 having an opening 12 in the upper part thereof is formed and an inner ring-shaped step 13 is formed in the lower end and on the inner circumference of the upper insertion part 11. The inner body 20 coupled with the brush 50 by the discharger 40 and the coupler 30 is inserted into the outer body 10.

An inner thread 21 is formed in the upper end and on the inner circumference of the inner body 20 inserted into the outer body 10 and a sealing ring 22 is tightly inserted into the lower part of the inner body 20.

A discharger insertion hole 31 is formed in the upper end of the coupler 30 thread coupled with the inner body 20. An outer ring-shaped step 32 is formed in the center and on the outer circumference of the coupler 30. An outer thread 33 is formed in the lower part and on the outer circumference of the coupler 30. A penetrating hole 34 and an inner ring-shaped step 35 are formed in the lower part and on the inner circumference of the coupler 30. The outer thread 33 is thread coupled with the inner thread 21 formed in the upper end of the inner body 20.

The brush 50 is inserted into the coupler 30 in the upper part of the coupler 30 and the discharger 40 into which a spring 49 is inserted is inserted into the coupler 30 in the lower part of the coupler 30. A slanted circumference 41 is formed in the lower part of the discharger 40 and the vertical liquid guiding passage 42 and the horizontal liquid guiding passage 43 are formed in the center of the discharger 40 to be connected to the discharge hole 44 provided in the upper part of the discharger 40. The check valve 45 and the spring 46 are inserted into the discharge hole 44.

A liquid transporting tube 51 provided with the brush 50 is inserted into the discharge hole 44 that forms the discharger 40 of the above structure in the upper part of the discharge hole 44.

A groove 47 is formed on the proper circumference of the discharge hole 40 so that a sealing O-ring 48 is inserted into the groove 47.

Therefore, the inner body 20 coupled with the brush 50 by the discharge hole 40 and the coupler 30 is inserted into the outer body 10 so that an upper body 60 and a cap 70 are coupled with the outer body 10. As a result, the cosmetics brush 1 illustrated in FIGS. 1 and 3 is obtained.

Reference numeral 38 denotes to a sealing O-ring.

The operation of the cosmetics brush 1 will be described as follows.

As illustrated in FIGS. 3 and 4, at normal times, the discharger 40 in which the spring 49 is inserted into the coupler 30 coupled with the inner body 20 in the upper part of the inner body 20 is inserted so that the inner body 20 faces downward due to the elastic force of the spring 49.

At this time, in the discharger 40 inserted into the coupler 30, the slanted circumference 41 formed in the lower end of the discharger 40 is positioned above the penetrating hole 34 formed in the lower end of the coupler 30 so that the penetrating hole 34 is opened and that the vertical and horizontal liquid guiding passages 42 and 43 and the discharge hole 44 formed in the discharger 40 and the liquid transporting tube 51 are connected to each other.

Cosmetics liquid is flown to the coupler 30 and the vertical and horizontal liquid guiding passages 42 and 43 connected to each other by the penetrating hole 34.

In the above-described structure, the inner body 20 faces downward so that no pressure is applied. Therefore, the check valve 45 inserted into the discharge hole 44 closes the upper part of the vertical liquid guiding passage 42.

Therefore, when the lower end of the inner body 20 is pressed after having the brush 50 of the cosmetics brush 1 face downward in a state where the penetrating hole 34 is opened, as illustrated in FIG. 4 (the brush 50 faces upward in the drawing), the coupler 30 coupled with the inner body 20 in the upper part of the inner body 20 moves so that the lower end of the discharger 40 inserted into the coupler 30 passes through the penetrating hole 34 to protrude in the inner body 20 and that the inner ring-shaped step 35 formed in the lower end of the coupler 30 is positioned in the lower part and on the circumference of the discharger 40. Therefore, the penetrating hole 44 is closed and the check valve 45 inserted into the discharge hole 44 ascends due to the pressure generated by pressing the inner body 20 into which the sealing ring 22 is inserted to be opened so that cosmetics liquid flown to the coupler 30 and the vertical and horizontal liquid guiding passages 42 and 43 is transported to the liquid transporting tube 51 through the discharge hole 44 and a plurality of vertical recesses 45*a* formed on the circumference of the check valve 45 to be discharged to the brush 50.

According to the cosmetics brush 1 of the present invention in which the penetrating hole 34 is opened and closed by repeatedly pressing the inner body 20, in order to discharge the cosmetics liquid stored in the inner body 20 to the brush 50, a user presses the lower part of the inner body 20 inserted into the outer body 10 so that the inner body 20 ascends. At this time, the inside of the inner body 20 is compressed by the sealing ring 22 inserted into the inner body 20 so that a proper amount of the cosmetics liquid stored in the inner body 20 is instantaneously pushed to the coupler 30 through the slanted circumference 41 formed in the lower end and on the circumference of the discharger 40 and the penetrating hole 34 formed inside and in the lower part of the coupler 30. When the inner body 20 is completely pressed, the inner body 20 maximally ascends so that the inner ring-shaped step 35 formed in the lower end of the coupler 30 is positioned in the lower end and on the circumference of the discharger 40 to close the penetrating hole 34.

The cosmetics liquid transported to the coupler 30 is discharged to the brush 50 through the vertical liquid guiding passage 42, the horizontal liquid guiding passage 43, and the discharge hole 44 formed in the discharger 40 and the liquid transporting tube 51. The liquid transporting tube 51 uniformly distributes the discharged cosmetics liquid to the brush 50.

At this time, the forcibly transported cosmetics liquid pushes the check valve 45 inserted into the discharge hole 34 upward to open the upper part of the vertical liquid guiding passage 42.

On the other hand, the sealing O-ring 48 inserted into the groove 47 formed on the circumference of the discharger 40 prevents the cosmetics liquid flown to the coupler 30 from leaking to the outside of the coupler 30.

Therefore, when the inner body 20 is released, the inner body 20 returns to an initial state due to the elastic force of the spring 49 supported to the discharger 40 in the coupler 30.

Also, the pressure of the inside of the inner body 20 increases while the inner body 20 returns to the initial state so that the check valve 45 inserted into the discharge hole 44 is inhaled to close the upper part of the vertical liquid guiding passage 42.

On the other hand, according to the present invention, the cosmetics brush 1 including the brush 50 has been described.

However, if necessary, a moist body (not shown) may be provided in the upper part of the discharge hole 44 that forms the discharger 40.

Although a few embodiments of the present invention have been shown and described, it would be appreciated by those skilled in the art that changes might be made in this embodiment without departing from the principles and spirit of the invention, the scope of which is defined in the claims and their equivalents.

As described above, according to the present invention, the lower part of the inner body whose upper part is thread coupled by the coupler and that includes the sealing ring in the inside thereof is pressed so that the cosmetics liquid stored in the inner body is discharged to the brush through the liquid guiding passages and the discharge hole formed in the discharger and the liquid transporting tube due to the air pressure generated while the inner body ascends and descends to let a user apply make-up. Also, since the inner body thread coupled by the coupler can be separated and refilled with cosmetics liquid when cosmetics liquid is exhausted, the cosmetics brush is economical and convenient.

What is claimed is:

1. A cosmetics brush in which cosmetics liquid is discharged to a brush using air pressure generated by pressing an inner body, the cosmetics brush comprising:

an outer body in which an upper insertion part having an opening in the upper part thereof is formed and an inner ring-shaped step is formed in the lower end, in the inside, and on the circumference of the upper insertion part;

an inner body in which an inner thread is formed in the upper end, in the inside, and on the circumference of the inner body and a sealing ring is tightly inserted into the lower part of the inner body so that the inner body is inserted into the outer body;

a coupler in which a discharger insertion hole is formed in the upper part of the coupler, an outer ring-shaped step is formed in the center, in the outside, and on the circumference of the coupler, an outer thread is formed in the lower part, in the outside, and on the circumference of the coupler, and a penetrating hole and an inner ring-shaped step are formed in the lower part, in the inside, and on the circumference of the coupler so that the coupler is thread coupled with the inner thread formed in the upper end of the inner body;

a discharger in which a slanted circumference is formed in the lower part of the discharger and a vertical liquid guiding passage and a horizontal liquid guiding passage are formed in the center of the discharger to be connected to a discharge hole provided in the upper part of the discharger, and a check valve and a spring are inserted into the discharge hole so that the discharger is inserted into the coupler;

a brush coupled with the upper part of the discharger by a liquid transporting tube; and an upper body and a cap coupled with the upper insertion part formed in the upper part of the outer body.

* * * * *